US006971901B2

(12) United States Patent
Chiu et al.

(10) Patent No.: US 6,971,901 B2
(45) Date of Patent: Dec. 6, 2005

(54) FLEXIBLE CIRCUIT BOARD CONNECTOR ENGAGING STRUCTURE

(75) Inventors: Hsien-Yu Chiu, Taoyuan (TW); Wen-Hsin Chen, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 10/768,119

(22) Filed: Feb. 2, 2004

(65) Prior Publication Data

US 2005/0095894 A1 May 5, 2005

(30) Foreign Application Priority Data

Oct. 31, 2003 (TW) ..... 92130590 A

(51) Int. Cl.[7] ..... H01R 13/62
(52) U.S. Cl. ..... 439/329
(58) Field of Search ..... 439/329, 331, 439/333, 492, 495, 496, 499

(56) References Cited

U.S. PATENT DOCUMENTS 2,923,911 A * 2/1960 Demurjian ..... 439/329
3,475,717 A * 10/1969 Lane ..... 439/260
5,173,058 A * 12/1992 Broeksteeg et al. ..... 439/267
5,474,468 A * 12/1995 Chishima et al. ..... 439/495

* cited by examiner

*Primary Examiner*—Javaid H. Nasri

(57) ABSTRACT

A flexible circuit board connector engaging structure capable of preventing a movable cover from disengaging with an insulation body includes inverted L-shaped ribs at front ends of flanks at the movable cover and for retaining movements of the movable cover. When the movable cover is moved to a located position, the inverted L-shaped ribs are retained by block panels of locating members, such that the movable cover cannot be further pulled outward. Meanwhile, front sections of the flanks at the movable cover are also tugged by the block panels of the locating members without being expanded outward, thereby preventing deformation and bending of the flanks at the movable cover as well as preventing the movable cover disengaging from the flexible circuit board connector. Thus, lifespan of the flexible circuit board connector is prolonged while also enhancing electric connection between a flexible flat cable (FFC) and the flexible circuit board connector.

9 Claims, 8 Drawing Sheets

FLEXIBLE CIRCUIT BOARD CONNECTOR ENGAGING STRUCTURE

BACKGROUND OF THE INVENTION (a) Field of the Invention

The invention relates to a flexible circuit board connector engaging structure, and more particularly, to flexible circuit board connector capable of preventing disengagement of a movable cover thereof.

(b) Description of the Prior Art

With reference to FIGS. 1 and 2, a prior flexible circuit board connector 10 comprises a longitudinal insulation body 11 (or a plastic core) accommodated with a U-shaped movable cover 12 (or a rear cover). The prior flexible circuit board connector 10 is disposed on a printed circuit board (PCB) 70 to become electrically connected with a flexible flat cable (FFC) 80.

Each of two side walls of the insulation body 11 is provided with a sliding track 11*a* serving as sliding guidance. Each sliding track 11*a* is extended with a locating block member 11*b* at a front end thereof. The insulation body 11 further has an embedding recess 14 and a plurality of channels 15 at an interior thereof, with each channel 15 being in communication with the embedding recess 14. A plurality of insertion terminals 50 is inlaid in the individual channels 15 one after another. When inserted in the embedding recess 14, the FFC 80 is electrically connected with the insertion terminals 50, and also with PCB 70 via the insertion terminals 50.

Right and left sides of the movable cover 12 are made of flanks 13 each having a sliding member 13*b* at a front end thereof. The left and right flanks 13 are joined with a press plate 16 such that the movable cover 12 appears as a U-shaped body. When the flanks 13 at the left and right sides of the movable cover 12 are accommodated into the sliding tracks 11*a* at the two side walls of the insulation body 11 using the sliding members 13*b* at the front ends thereof, a flexible circuit board connector 10 is formed by the movable cover 12 and the insulation body 11.

Using a set of sliding mechanism developed from the sliding members 13*b* at the movable cover 12 and the sliding tracks 11*a* at the insulation body 11, the movable cover 12 of the prior flexible circuit board connector 10 can be drawn for coverage. Meanwhile, when the movable cover 12 is drawn, the sliding members 13*b* thereof come into contact with the locating block members 11*b* at the front ends of the sliding channels 11*a* of the insulation body 11, and a certain distance between the movable cover 12 and the insulation body 11 is limited. Thus, not only the movable cover 12 is prevented from being disengaged with the insulation body 11, but also an opening of the embedding recess 14 at the insulation body 11 remains totally exposed and unshielded by the press plate 16, so as to facilitate insertion of the FFC 80 into the embedding recess 14 at the insulation body 11. When the movable cover 12 is closed and located tightly relative to the insulation body 11, the press plate 16 of the movable cover 12 is extended into embedding recess 14 at the insulation body 11, such that the FEC 80 is pressed by the press plate 16 and steadily positioned in the embedding recess 14 at the insulation body to become electrically connected with the insertion terminals 50.

However, because the left and right sides of the aforesaid U-shaped movable cover 12 are provided with flanks 13, which are long and narrow plate-like structures and are necessarily disposed with the protruding sliding members 13*b*, a thickness of the flanks 13 cannot be too large and is even considered rather inadequate. Therefore, when encountering external forces, deformation or bending of the flanks 13 is often resulted after being used. When forces for drawing the movable cover 12 get slightly excessive, the sliding members 13*b* at the left and right sides of the flanks 13 frequently become unlocked with and no longer retained by the locating block members 1l*b*. Consequently, the movable cover 12 is disengaged from the insulation body 11 to leave the prior flexible circuit board connector 10 inapplicable. Even if the sliding members 13*b* at the movable cover 12 are again accommodated into the sliding channels 11*a* of the insulation body 11, due to deformation or bending of the flanks 13 at the movable cover 12, the FFC 80 fails to be steadily located in the embedding recess 14 at the insulation body 11, and poor electric connection between the FFC 80 and the flexible circuit board connector 10 is incurred.

SUMMARY OF THE INVENTION

The primary object of the invention is to provide a flexible circuit board connector capable of preventing disengagement of a movable cover thereof, so as to prohibit the movable cover of the flexible circuit board connector from disengaging from an insulation body and thereby overcoming drawbacks of a prior flexible circuit board connector.

The secondary object of the invention is to provide a flexible circuit board connector capable of preventing disengagement of a movable cover thereof, in that flanks of the movable cover are provided with inverted L-shaped ribs for retaining movements of the movable cover. When the movable cover is drawn to reach a located position, the inverted L-shaped ribs at the movable cover are also retained such that the movable cover cannot be pulled further. Front sections of the flanks at the movable cover are also tugged by block panels of locating members, and are thus not expanded outward or moved. As a result, the flanks at the movable cover are prevented from deformation or bending, thereby lengthening usage lifespan of the flexible circuit board connector as well as enhancing electric connection between a flexible flat cable (FFC) and the flexible board circuit connector.

DETAILED DESCRIPTION OF THE PREFERRED EMBODIMENTS

Figure 1:
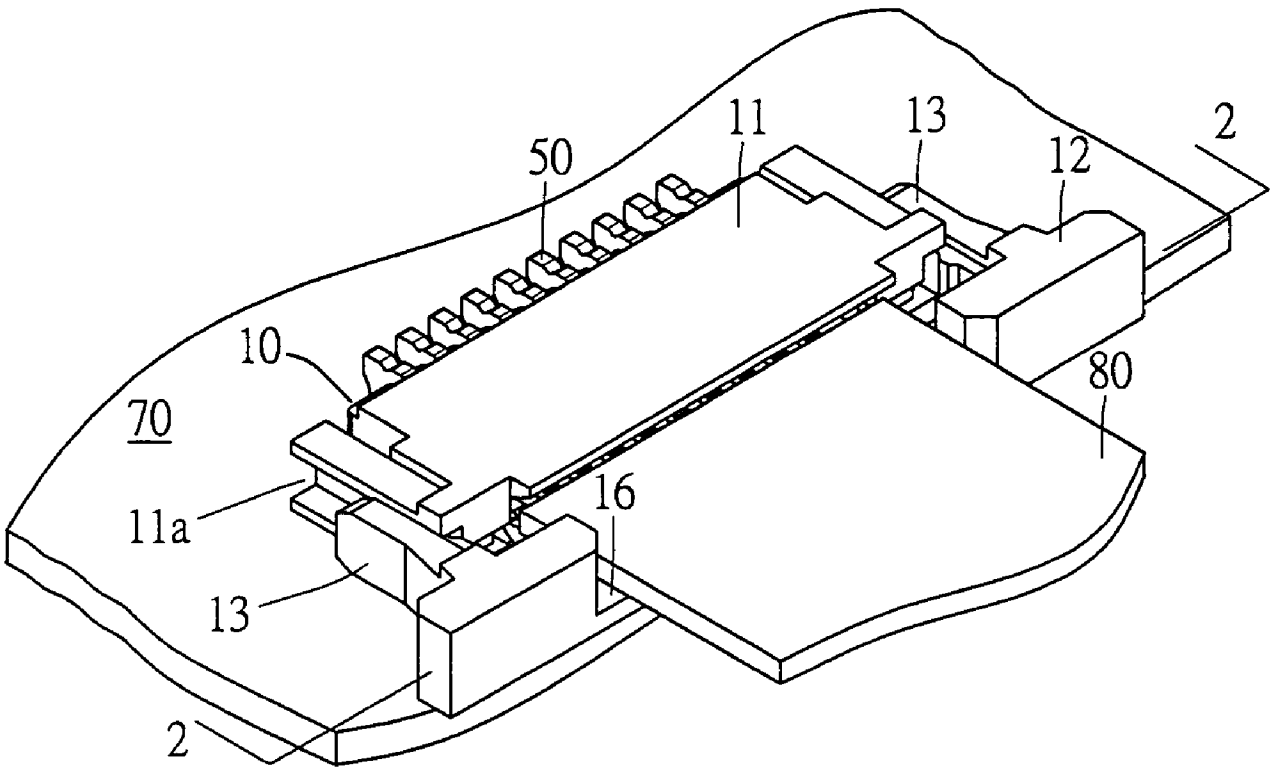
FIG. 1 (prior art)
FIG. 1 shows a perspective view illustrating a prior flexible circuit board connector 10 in use.
Figure 2:
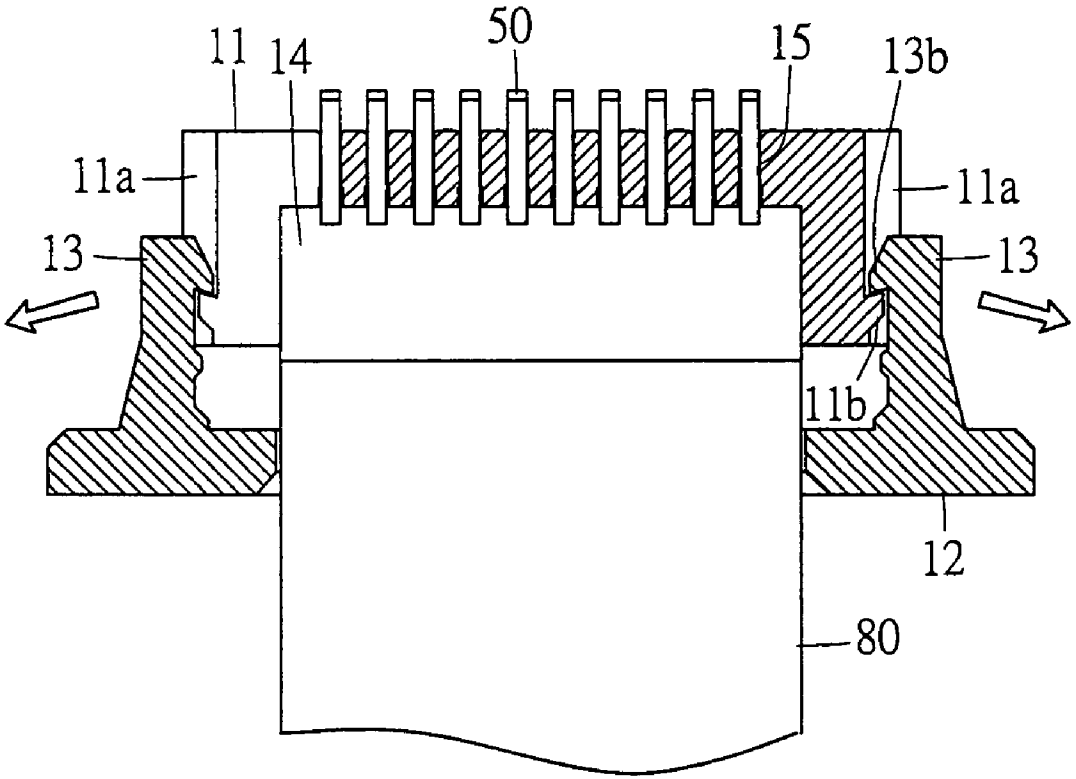
FIG. 2 (prior art)
FIG. 2 shows a sectional view of the flexible circuit board connector 10 in FIG. 1 taken along a sectional line 2—2, and illustrates that the movable cover 12 is easily disengaged from the insulation body 11 when being drawn.
Figure 3:
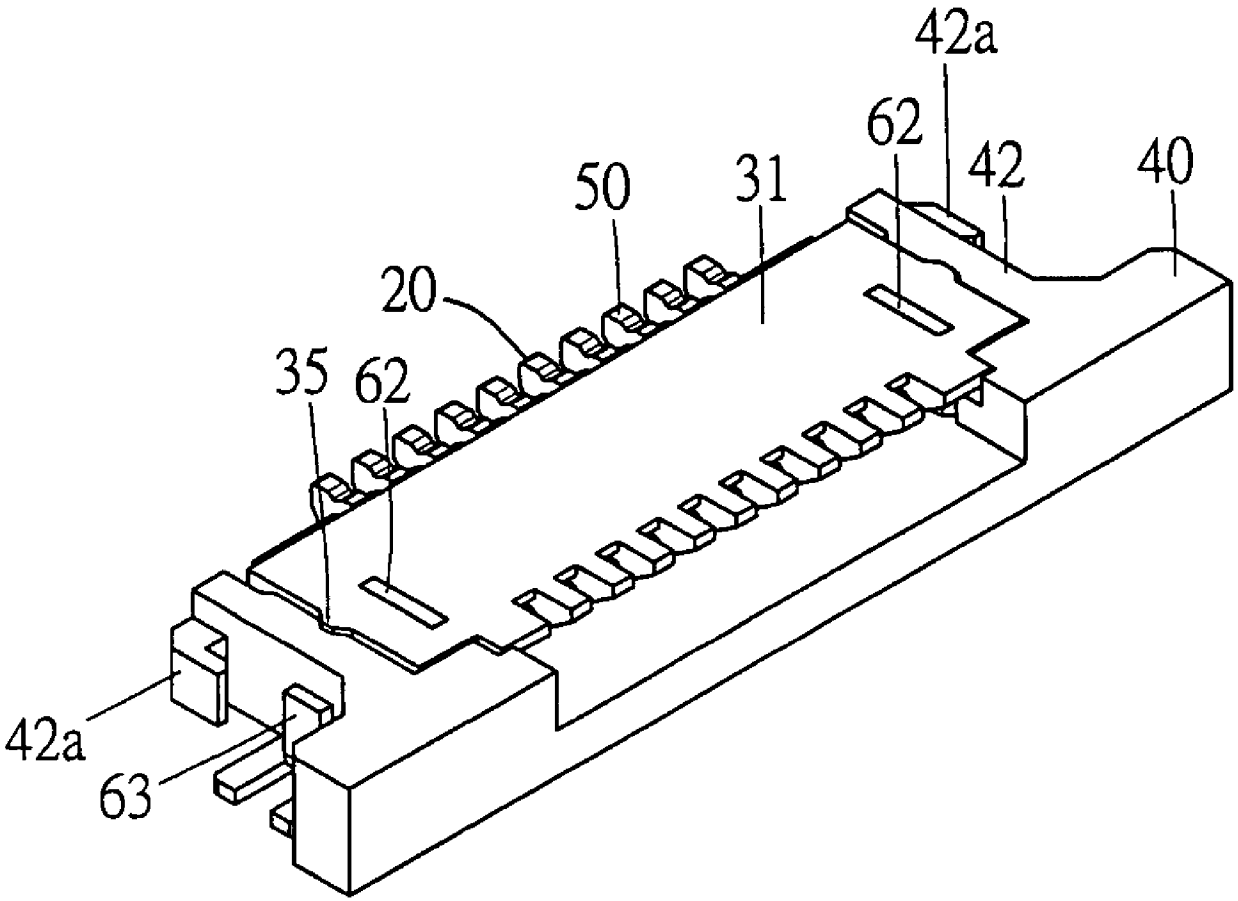
FIG. 3 shows a perspective schematic view of the flexible circuit board connector 20 according to the invention.
Figure 4:
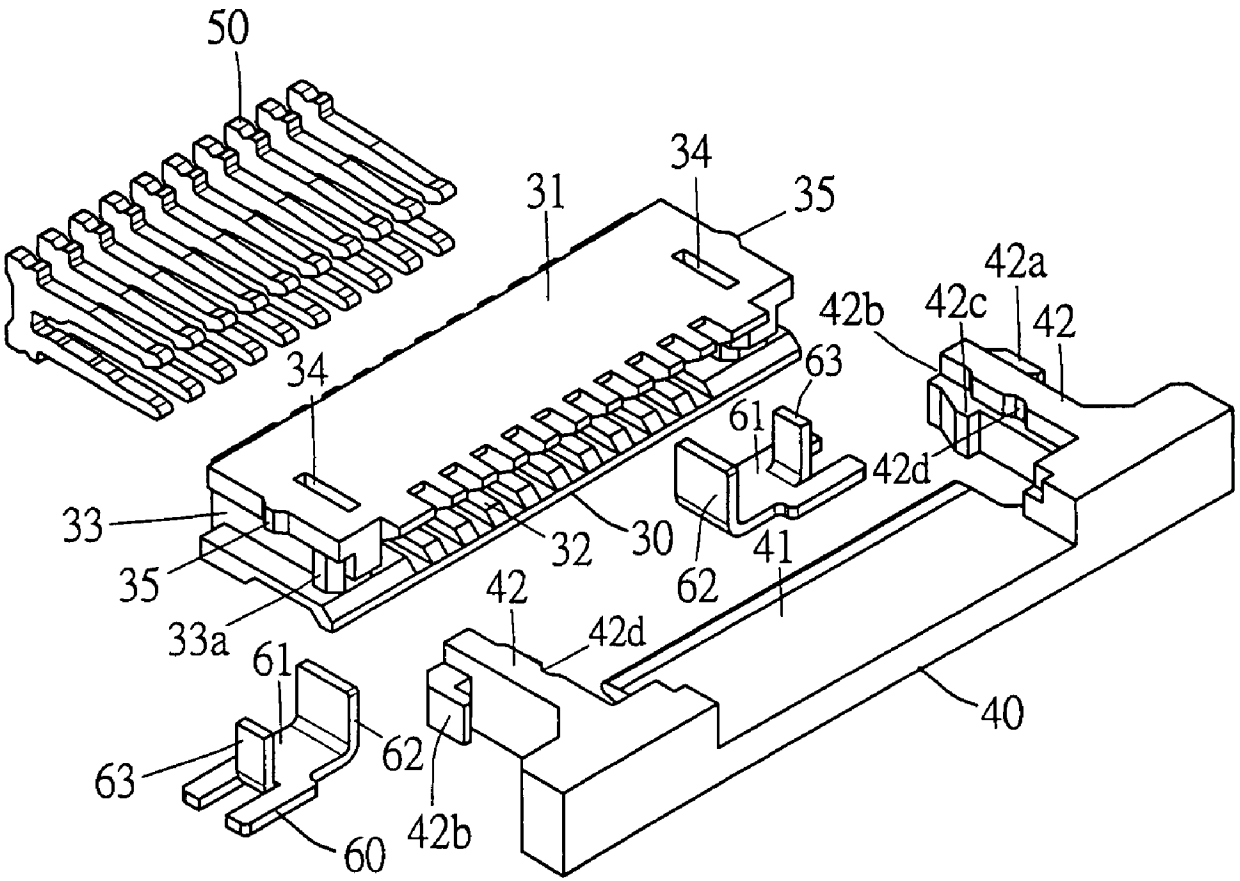
FIG. 4 shows an exploded view of parts in the flexible circuit board connector 20 according to the invention.

Referring to FIGS. 3 and 4, a flexible circuit board connector 20 according to the invention comprises a longitudinal insulation body 30, a U-shaped movable cover 40, a plurality of insertion terminals 50, and a pair of locating members 60.

The insulation body 30 has internal structures identical to those of a prior invention and includes an embedding recess 32 and a plurality of channels for placing the insertion terminals 50. Each of two side walls of the insulation body 30 is provided with a sliding track 33 serving as sliding guidance. Each sliding track 33 is extended with a block member 33*a* at a front end thereof.

The insulation body 30 further has an indented embedding slot 34 at an area near each of two sides of a obverse 31 thereof. Each embedding slot 34 may be devised as a groove penetrated trough the insulation body 30, or as a groove having a certain depth at a lower plane of the insulation body 30. However, positions of the embedding slots 34 have no undesired effects on the sliding tracks 33 at the two side walls of the insulation body, and also leave the embedding recess 32 at the insulation body 30 undamaged.

The obverse plane 31 of the insulation body 30 is formed with an extended flange 35 at a middle portion at each of two sides thereof, so as to develop into another embodiment according to the invention.

The movable cover 40 is a U-shaped structure consisted of a press plate 41 and flanks 42 at two sides of the press plate 41. Each flank 42 is provided with an inverted L-shaped rib 42*a* at an outer front portion thereof, a guiding track 42*b* at an inner side thereof, and a sliding member 42*c* at an inner front portion thereof. In addition, each guiding track 42*b* has a depth approximating a thickness at two sides of the obverse plane 31 of the insulation body 30. A distance between the guiding tracks 42*b* at the two sides of the movable cover 40 is slightly larger than that between the left and right sides of the obverse plane 31 of the insulation body 30.

Figure 5:
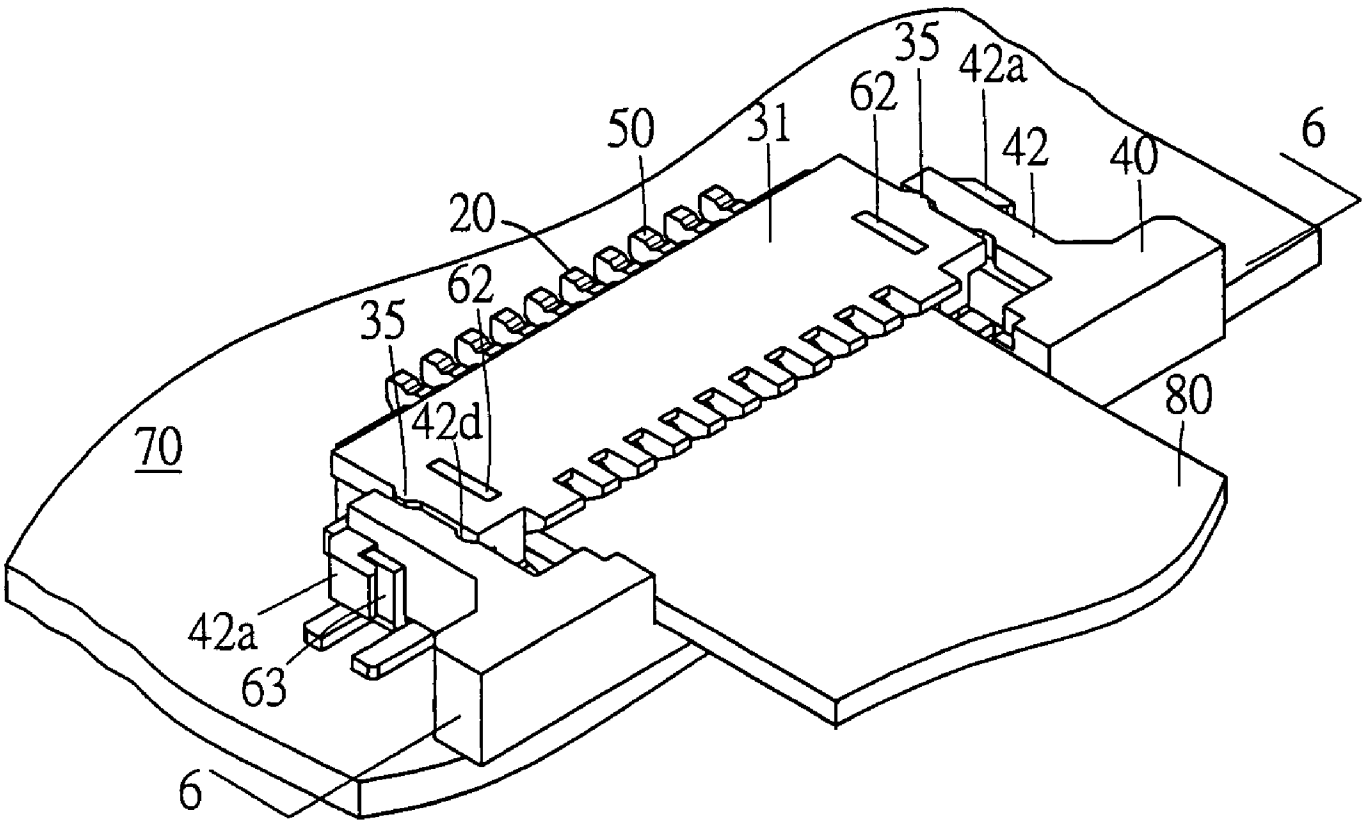
FIG. 5 shows a view according to the invention in use when the movable cover 40 is drawn.
Figure 7:
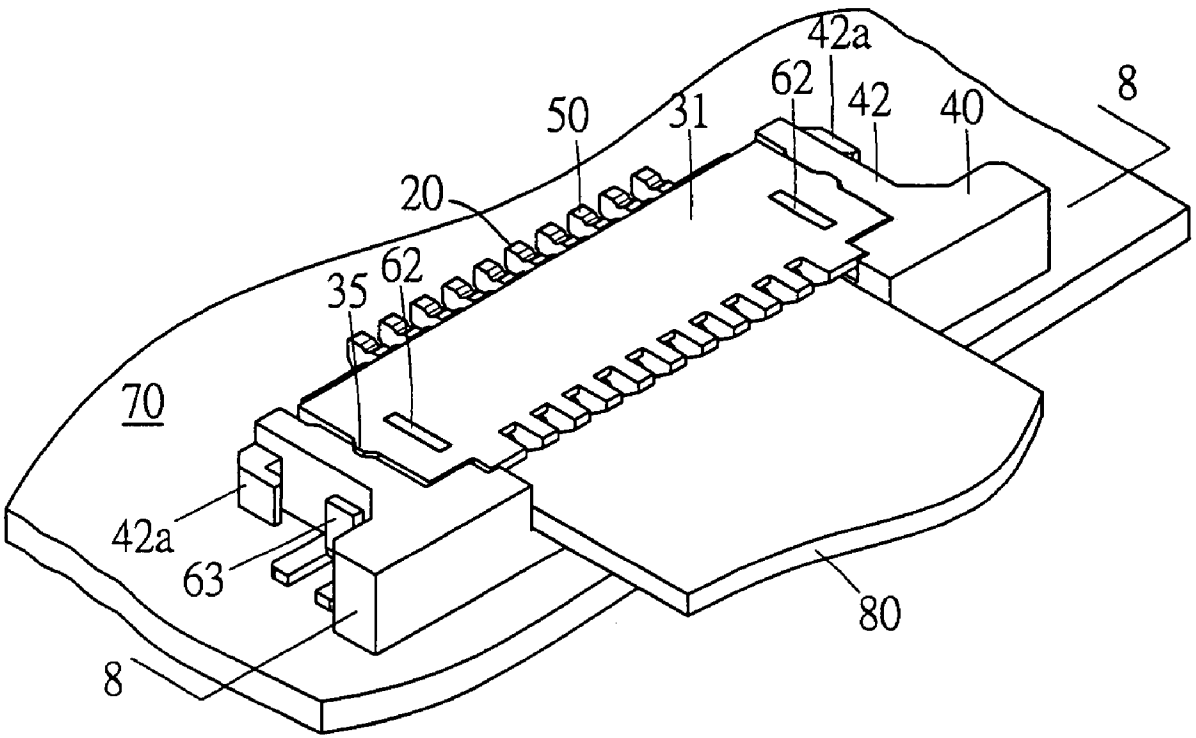
FIG. 7 shows a view of the flexible circuit board connector 10 according to the invention in use when the movable cover 40 is closed.
Figure 8:
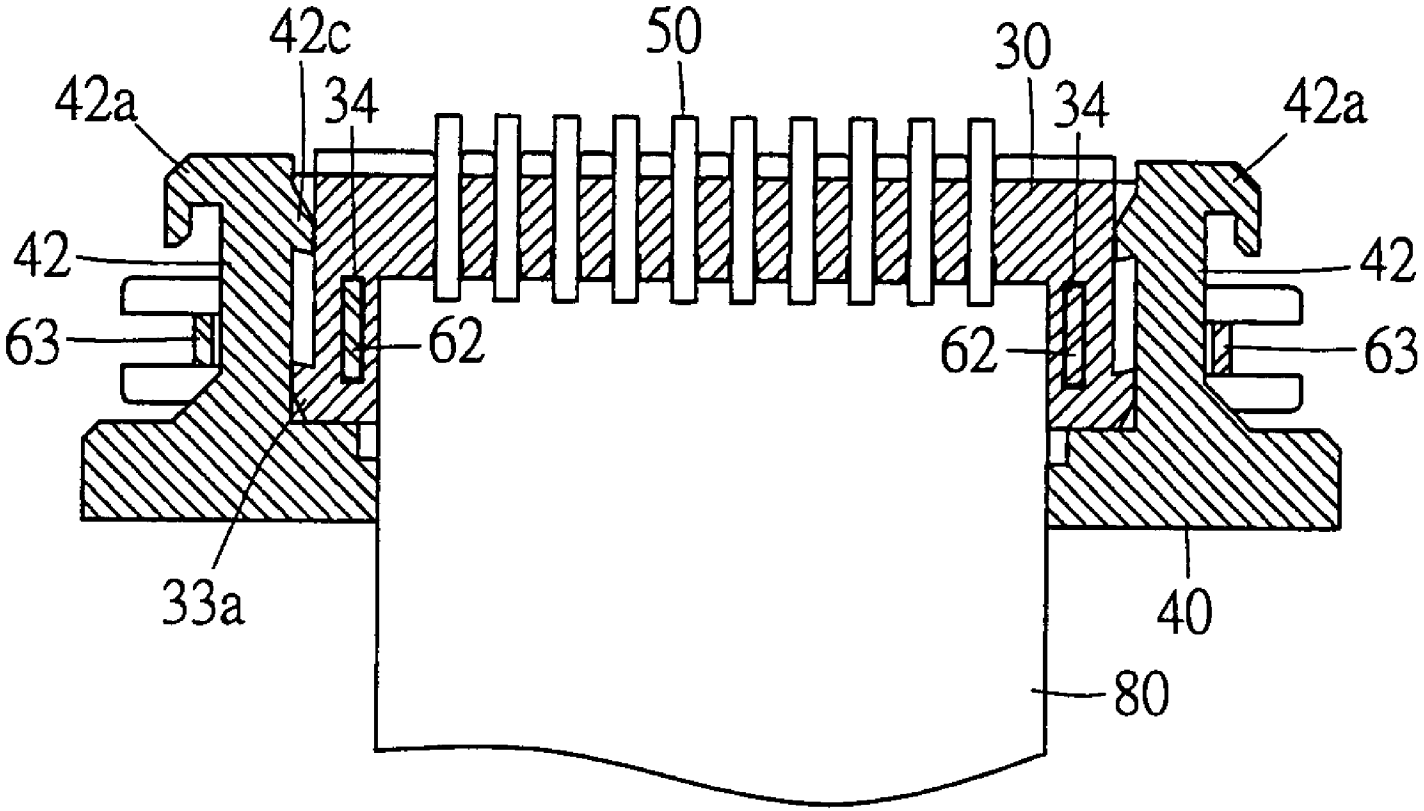
FIG. 8 shows a sectional view of FIG. 7 taken along a sectional line 8—8, and illustrates that the insertion terminals 50 of the flexible circuit board connector 20 are steadily in electric connection with the FFC 80.

Referring to FIGS. 3 to 5, when the sliding members 42*c* of the flanks 42 at the left and right sides of the movable cover 40 are individually accommodated into the sliding tracks 33 at the two side walls of the insulation body 30, the left and right sides of the obverse plane 31 of the insulation body 30 are placed at the guiding tracks 42*b* at the left and right sides of the movable cover 40. When the movable cover 40 is drawn or closed, apart from the sliding members 42*c* of the movable cover 40 sliding relatively in the sliding tracks 33*a* of the insulation body 30, the guiding tracks 42*b* of the movable cover 40 also have effects of guiding the movable cover 40 to slide smoothly. Similarly, with reference to FIGS. 3, 5 and 7, in order to enable insulation body 30 having the obverse plane 31 with the flanges 35 at the two sides to be placed on the guiding tracks 42*b* at the two sides of the movable cover 40, the guiding tracks 42 of the movable cover 40 may also be utilized for guiding and locating the movable cover 40. Thus, each guiding track 42*b* of the movable cover 40 is excavated with a flange indenture 42*e* at a middle section of a vertical plane thereof for corresponding with a shape of each flange 35, and is also formed with an indenture 42*e* at a rear section of the vertical plane thereof. When the movable cover 40 is drawn, the indentures 42*e* are for accommodating the flanges 35 of the insulation body 30 as shown in FIG. 7. When the movable cover 40 is closed, the flanges 35 of the insulation body 30 are entered into the flanges indentures 42*d* to indicate that the movable cover 40 has reached a located position as shown in FIG. 7.

The locating members 60 are integrals with a lower panel 61, a press panel 62 and block panel 63 in structure. Wherein, the lower panel 61 is a horizontal rectangular plate, and the press panel 62 and the block panel 63 are vertical plates having a certain distance in between and being parallel to each other. Furthermore, the press panels 62 are bent and formed at a side of the lower panel 61. A vertical plane of each press panel 62 has a width slightly smaller than that of the embedding slots 34, and therefore the press panels 62 of the locating members 60 can be placed into the embedding slots 34 of the insulation body 30

According to the aforesaid descriptions and with reference to FIGS. 5 to 8, for an assembly of the locating member 60, the insulation body 30, the movable cover 40 and the plurality of insertion terminals 50 into the flexible circuit board connector 20 according to the invention, when the movable cover 40 is drawn to a located position, the inverted L-shaped ribs 42*a* at the front ends of the left and right side flanks 42 of the movable cover 40 are retained by the block panels 63 of the locating members 60 and cannot be moved further in a direction being pulled. Moreover, outer front portions of the flanks 42 at the movable cover 40 are also tugged by the block panels 63 of the locating members 60, thereby preventing the movable cover 40 from disengaging with the insulation body 30.

Referring to FIGS. 5 to 8 showing an embodiment according to the invention, the flexible circuit board connector 20 comprises a longitudinal insulation body 30, a U-shaped movable cover 40, a plurality of insertion terminals 50, and a pair of locating members 60. By welding the lower panels 61 of the locating members 60, the flexible circuit board connector 20 is mounted on a printed circuit board (PCB) 70.

Figure 6:
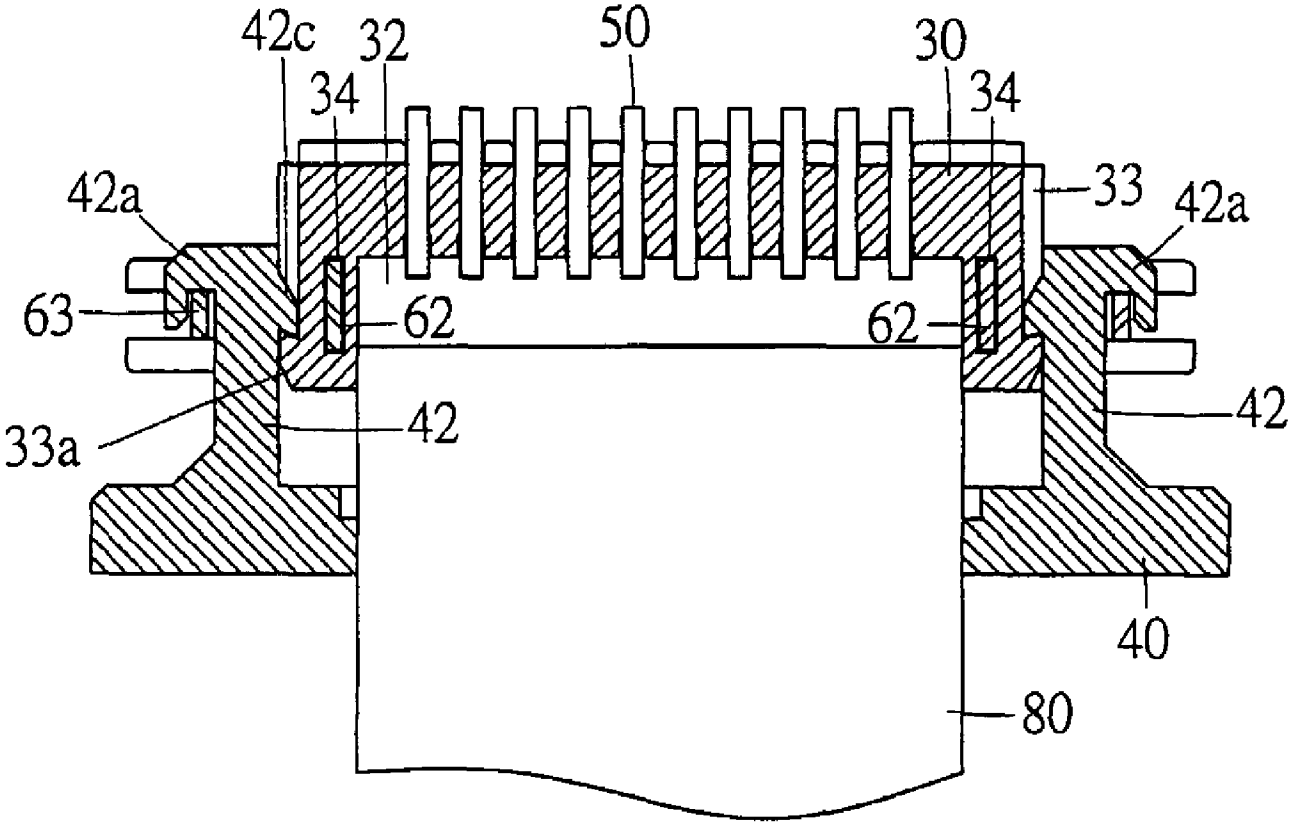
FIG. 6 shows a sectional view of FIG. 5 taken along a sectional line 6—6. When the movable cover 40 is drawn, the locating member 60 locates the movable cover and prevents the two side flanks 42 at the movable cover 40 from disengaging with the insulation body 30.

To put the invention to use, referring to FIGS. 5 and 6, the movable cover 60 is drawn until it cannot be linearly moved further. At this point, the inverted L-shaped ribs 42*a* at the outer front ends of the flanks 42 at the movable cover 42 come into contact with the block members 63 of the locating members 60, thereby locating the movable cover 40. Meanwhile, the front sections of the flanks 42 at the movable cover 40 are retained by the block members 63 having confining effects, and hence the flanks 42 at the movable cover 40 are prevented from bending or deformation as well as avoiding the movable cover 40 from disengaging with the insulation body 30.

When the a flexible flat cable (FFC) 80 is inserted into the embedding recess 32 at the insulation body 30 to become electrically connected with the insertion terminals 50 therein, a reverse procedure is performed to push the movable cover 40 to the insulation body 30 for location. That is, the flanges 35 of the insulation body 30 are placed into the flange indentures 42*d* at the movable cover 40. At this point, the press plate 41 is extended into the embedding recess 32 of the insulation body 30 to stabilize the FFC 80 in the embedding recess 32, thereby forming good electric connection between the FFC 80 and the PCB 70.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A flexible circuit board connector engaging structure comprising a longitudinal insulation body, a U-shaped movable cover, a plurality of insertion terminals, and a pair of locating members; wherein:

the insulation body has a sliding track at each of two sides thereof, and an excavated embedding slot at a position near each sides of obverse plane thereof;

the movable cover has left and right sides formed by flanks, which are provided with sliding members at inner front portions thereof and inverted L-shaped ribs at outer front portions thereof, with the sliding members of the flanks accommodated in the sliding tracks of the insulation body; and the pair of locating members are integral with a lower panel, a press panel and a block panel in structure; the lower panel is a horizontal plate, and the press panel and the block panel are vertical plates having a certain distance in between and being parallel to each other; the press panel is bent and formed at a side of the lower panel; and the press panel of the locating member is placed into the embedding slot of the insulation body, such that the block panel has confining effects upon the inverted L-shaped ribs of the movable cover when the movable cover is drawn in position.

2. The flexible circuit board connector engaging structure in, accordance with claim 1, wherein each flank at the movable cover is provided with a guiding track at an inner side thereof and a sliding member at an inner front portion thereof.

3. The flexible circuit board connector engaging structure in accordance with claim 2, wherein an obverse plane of the insulation body is formed wit an extended flange at a middle portion at each of two sides thereof, and each guiding track of the movable cover is excavated with a flange indenture at a middle section of a vertical plane thereof.

4. The flexible circuit board connector engaging structure in accordance with claim 1, wherein the embedding slots of the insulation body are grooves penetrated through the insulation body.

5. The flexible circuit board connector engaging structure in accordance with claim 2, wherein the embedding slots of the insulation body are grooves penetrated through the insulation body.

6. The flexible circuit board connector engaging structure in accordance with claim 3, wherein the embedding slots of the insulation body are grooves penetrated through the insulation body.

7. The flexible circuit board connector engaging structure in accordance with claim 1, wherein the locating members are symmetrical structures.

8. The flexible circuit board connector engaging structure in accordance with claim 2, wherein the locating members are symmetrical structures.

9. The flexible circuit board connector engaging structure in accordance with claim 3, wherein the locating members are symmetrical structures.

* * * * *